United States Patent [19]

Lentz

[11] 4,257,699

[45] Mar. 24, 1981

[54] METAL FILLED, MULTI-LAYERED ELASTOMER FUSER MEMBER

[75] Inventor: James A. Lentz, Penfield, N.Y.

[73] Assignee: Xerox Corporation, Stamford, Conn.

[21] Appl. No.: 26,869

[22] Filed: Apr. 4, 1979

[51] Int. Cl.[3] ..... B05C 11/02; B21B 31/08

[52] U.S. Cl. ..... 355/3 FU; 29/132; 219/216; 219/388; 430/98; 430/99; 432/60; 432/228

[58] Field of Search ..... 29/132; 430/98, 99; 118/60, 101; 432/60, 228; 355/3 FU; 219/216, 388

[56] References Cited

U.S. PATENT DOCUMENTS

| | | | |
|---|---|---|---|
| 2,970,906 | 2/1961 | Bixby | 250/315 A X |
| 3,002,927 | 10/1961 | Awe et al. | 252/37.2 |
| 3,098,836 | 7/1963 | Bobear | 260/37 SB |
| 3,435,500 | 4/1969 | Aser et al. | 29/130 |
| 3,669,707 | 6/1972 | Donnelly et al. | 427/444 |
| 3,852,861 | 12/1974 | Baker et al. | 29/132 |
| 3,884,950 | 5/1975 | Koda et al. | 260/45.75 R X |
| 3,937,637 | 2/1976 | Moser et al. | 148/6 |
| 3,942,230 | 3/1976 | Nalband | 29/132 |
| 4,011,362 | 3/1977 | Stewart | 428/447 |
| 4,029,827 | 6/1977 | Imperial et al. | 427/374 R X |
| 4,046,795 | 9/1977 | Martin | 260/448.2 E |
| 4,064,313 | 12/1977 | Takiguchi et al. | 428/447 |
| 4,078,285 | 3/1978 | Seanor | 29/132 |
| 4,078,286 | 3/1978 | Takiguichi et al. | 29/132 |
| 4,083,092 | 4/1978 | Imperial et al. | 29/132 |
| 4,101,686 | 7/1978 | Strella et al. | 29/132 X |

OTHER PUBLICATIONS

Abstract in Derwents , "Electrophotography" for W. German, 2,824,994.

Abstract in Derwents, "Electrophotography" for Japanese Patent Application, J53089-743.

*Research Disclosures,* Product Licensing Index, Jul. 1977, pp. 72-73.

Viton Fluoroelastomer Crosslinking by Bisphenols, W. Wschmiegle, paper presented at S. German, Apr. 28-29, 1977, Deutche Kautschuk und G. G.

Conductive Polymeric Compositions, D. M. Bigg, PES 12/1977, vol. 17, No. 12, pp. 842-847.

RPN Technical Notebook, Sep. 18, 1978.

*Primary Examiner*—Ronald H. Smith

*Assistant Examiner*—Thurman K. Page

*Attorney, Agent, or Firm*—Harvey M. Brownrout; Peter H. Kondo; James F. Tao

[57] ABSTRACT

A fuser member, fuser assembly and method of fusing or fixing thermoplastic resin powder images to a substrate in a fuser assembly of the type wherein a polymeric release agent having functional groups is applied to the surface of the fuser member is disclosed. The fuser member comprises a base member having at least two layers of elastomer thereon, at least the outer layer elastomer surface having a metal-containing filler therein. Exemplary of such a fuser member is an aluminum base member coated with a first layer of poly(-vinylidene fluoride-hexafluoropropylene) copolymer optionally having a metal-containing filler, such as lead oxide, dispersed therein and at least a second layer of poly(vinylidene fluoride-hexafluoropropylene) copolymer having metal-containing filler, such as lead oxide, dispersed therein coated upon said first layer.

53 Claims, 3 Drawing Figures

METAL FILLED, MULTI-LAYERED ELASTOMER FUSER MEMBER

This invention relates generally to heat fusing members, assemblies and methods, and more particularly, to an improved fusing surface and method to prevent offsetting of a resin-based powder fused upon a substrate during the fusing operation. As used herein, the fusing surface may be a roll, a belt, a flat surface or any other shape suitable for fixing toner or resin-based powder images. The invention is particularly useful in the field of xerography where images are electrostatically formed and developed with resinous powders known as toners or thermoplastic resin powders, and thereafter fused or fixed onto sheets of paper or other substrates to which the powder images have been transferred. The resin-based powders or toners of this invention are heat softenable, such as those provided by toners which contain thermoplastic resins and used conventionally in a variety of commercially known methods.

In order to fuse images formed of the resinous powders or toners, it is necessary to heat the powder and the substrate to which it is to be fused, to a relatively high temperature, generally in excess of about 90° C. This will vary depending upon the softening range of the particular resin used in the toner. Generally, even higher temperatures are contemplated such as approximately 160° C. or higher. It is undesirable, however, to raise the temperature of the substrate substantially higher than about 200° C. because of the tendency of the substrate to discolor at such elevated temperatures, particularly when the substrate is paper.

It has long been recognized that one of the fastest and most positive methods of applying heat for fusing the powder image is direct contact of the resin-based powder with a hot surface, such as a heated roll. But, in most instances, as the powder image is tackified by heat, part of the image carried by the support material will stick to the surface of the plate or roll so that as the next sheet is advanced on the heated roll, the tackified image, partially removed from the first sheet, will partly transfer to the next sheet and at the same time part of the tackified image from said next sheet adheres to the heated roll. This process is commonly referred to in the art as "offset" or "hot offset", terms now well-known in the art.

The offset of toner onto the heated surface led to the development of improved methods and apparatus for fusing the toner image. These improvements comprised fusing toner images by forwarding the sheet or web or substrate material bearing the image between two rolls at least one of which was heated, the rolls contacting the image being provided with an abhesive surface such as a thin coating of tetrafluoroethylene resin and a silicone oil film to prevent toner offset. The outer surfaces of such rolls have also been fabricated of fluorinated ethylene/propylene polymers, elastomers which contain hexafluoropropylene as a comonomer such as poly(vinylidene fluoride/hexafluoropropylene) or silicone elastomers coated with silicone oil as well as silicone elastomers containing low surface energy fillers such as fluorinated organic polymers, and the like. The tendency of these rolls to pick up the toner generally requires some type of release fluid continuously applied to the surface of the roll to prevent hot offset, and commonly known silicone oils are generally well adapted for this purpose. Bare metal fuser members having functionalized polymeric release agents upon their surfaces are also well-known in the art. The functionalized polymeric release agents, such as mercapto-functional polyorganosiloxanes, are generally well adapted for release of thermoplastic resin toner from the heated surfaces of bare metal fuser members.

Although the foregoing fuser members used in conjunction with various fuser release agents have been successfully used to fuse thermoplastic resin toners to various substrates, each of the prior art combinations has various disadvantages. For example, many of the prior art systems are incapable of fusing toner images to substrates at high speeds. Others consume large amounts of expensive fuser oil or fuser release agent. Still other prior art fusing systems compromise copy quality even though they are capable of fusing large numbers of copies. Many of the fuser member structures are subject to wear and degradation due to continued operation at elevated temperature, or the outer layer or layers of elastomers are not secured sufficiently to the base member to permit extensive use for prolonged periods. This necessitates replacement of the fuser member which is quite costly when a large number of machines are involved. Moreover, many of the fuser members having elastomeric and resinous layers of material along with a coating of silicone oil to prevent toner offset are of sufficient thickness to constitute a poor thermal conductor, and longer nip dwell and higher fuser roll temperatures are required to deliver the fusing energy required to fix toner. Also, control of the surface temperature of the roll presents a problem due to large temperature variations occurring before and after contacting of the substrate bearing the images.

OBJECTS OF THE INVENTION

Accordingly, it is the principle object of this invention to provide a fuser member and method for rapidly fixing resinous powder images at high speeds without causing offset or hot offset.

Another object of this invention is to provide a fuser member with an elastomer or resin surface wherein the elastomer or resin is fortified with a high energy filler to promote release and prevent offset when used with specified functional release agents.

It is another object of this invention to provide a fuser member and method of fusing wherein the surface layer of the fuser member has excellent thermal conductivity.

Still another object of this invention is to provide a fuser member and method of fusing whereby there is an interaction between the elastomer or resinous surface material of the fuser member and the fuser release agent or fuser oil applied to the surface thereof.

It is another object of this invention to provide a fuser member, fuser assembly and method of fusing with an elastomer or resin surface layer fortified with fillers in which no separation occurs between the core or base and the elastomer of resin surface when polymeric release agents have functional groups are applied upon the working surface of the elastomer.

Other objects and advantages of the present invention will become apparent when read in conjunction with the accompanying drawings and specification.

SUMMARY OF THE INVENTION

The above-cited objects of the invention are accomplished by applying a polymeric release agent having functional groups upon the surface of a fuser member comprising a base member, at least one base layer of elastomer upon the base member and an outer layer of an elastomer coated upon the base layer of elastomer, said outer layer of elastomer having metal-containing filler dispersed therein. The metal-containing filler dispersed in the outer layer of elastomer must be present in an amount sufficient to interact with the polymeric release agent having functional groups upon the working surface of the fuser member. The fuser member which may be a roll, a belt, a flat surface or other substrate having a suitable shape for fixing thermoplastic resin powder images to a substrate at elevated temperatures in a fuser assembly of the type wherein the polymeric release agent having functional groups is used as an abhesive layer upon the working surface of the fuser member, comprises a base member, at least one base layer of elastomer upon the base member, said base layer elastomer optionally containing a metalcontaining filler dispersed therein, and an outer layer of an elastomer coated upon the base layer of elastomer, said outer layer of elastomer having a metal-containing filler, such as a metal, metal alloy, metal salt or metal oxide, dispersed therein in an amount sufficient to interact with a polymeric release agent having functional groups, said polymeric release agent being applied to the elastomer surface to provide a surface abhesive to the thermoplastic resin toner or powder. Thus, there is provided a multi-layered fuser member for fixing thermoplastic resin powder images to a substrate in a fuser assembly of the type wherein a polymeric release agent having functional groups is applied to the working surface of the fuser member, comprising a base member, at least one base layer of elastomer coated upon the base member, said base layer elastomer optionally having a metal-containing filler dispersed therein, and an outer layer of an elastomer having a metal-containing filler dispersed therein in an amount sufficient to interact with polymeric release agent having functional groups used upon the working surface.

There is also provided a method of fusing thermoplastic resin toner images to a substrate comprising: (a) forming a film of polymeric release agent having functional groups upon an outer elastomer surface of a fuser member at elevated temperatures, said fuser member comprising a base member, at least one base layer of elastomer adhered to the base member and another layer of an elastomer coated upon the base layer elastomer, said outer elastomer layer having metal-containing filler dispersed therein in an amount sufficient to interact with the polymeric release agent having functional groups, and said base layer elastomer optionally containing metal-containing filler dispersed therein; (b) contacting the toner images on said substrate with the coated, heated elastomer surface for a period of time sufficient to soften the toner; and (c) allowing the toner to cool. The thermoplastic resin powder is fixed to the substrate by contacting the substrate bearing the thermoplastic resin powder image with the heated surface of the described outer layer of elastomer containing metal oxide, metal salt, metal or metal alloy filler and covered with a polymeric release agent having functional groups for a time and at a temperature sufficient to permit the fusion of the thermoplastic resin powder to the substrate. The surface of the outer layer elastomer having metal oxide, metal salt, metal, metal alloy or other suitable metal compound filler dispersed therein is abhesive to tackified or molten thermoplastic resin powder undergoing fusion on the substrate because the surface of the outer layer of elastomer having metal oxide, metal salt, metal, metal alloy or other suitable metal compound filler dispersed therein bears a film of polymeric release agent having functional groups which have interacted with the metal, metal alloy, metal salt, metal oxide or other suitable metal compound filler of the elastomer. Because of the synergism between the outer layer of elastomer having metal oxide, metal salt, metal, metal alloy or other suitable metal compound filler dispersed therein and the polymeric release agent having functional groups, excellent release and the production of high quality copies are obtained even at high rates of speed of electrostatic reproducing machines. The outer layer of elastomer is coated upon at least one base layer of elastomer which base layer is coated upon a base member and adhered thereto by any suitable adhesive. This base layer of elastomer promotes the adhesion of the outer layer of elastomer to the base member and may be defined by several elastomer layers intermediate the outer layer of elastomer and the base member.

In another improvement, when the elastomers of the base layer and the outer layer are cured by a special curing or crosslinking agent or process, and the elastomer of at least the outer layer has incorporated therein a metal-containing filler in accordance with the present invention, there is not only the realization of the fusing or fixing of a large number of copies, that is the improved release, but there is also a substantial improvement in wear rate and adhesion to the base layer elastomer over the elastomers cured by conventional curing or crosslinking agents, for example free radical initiator agents such as peroxides. Thus, when elastomers such as fluoroelastomers, are cured by a nucleophilic addition curing or crosslinking system, and at least the outer layer of fluoroelastomer contains a metal-containing filler, a superior multi-layered fuser member and method of fusing are obtained.

There is also provided in a heated pressure fusing system for fixing toner images in an electrostatic reproducing apparatus in which a fuser roll and a backup roll define a contact arc to fuse toner images onto a substrate and a release agent is applied to the surface of the fuser roll to prevent toner offset upon the fuser roll, the improvement comprising a fuser roll having a cylindrical base member, at least one-base layer of elastomer adhered to the base member, said base layer of elastomer optionally containing a metal-containing filler dispersed therein, and an outer layer of an elastomer coated upon the base layer of elastomer, said outer layer of an elastomer having a metal-containing filler dispersed therein, the release agent applied upon the surface of the elastomer being a polymeric release agent having functional groups which interact with the metal in the metal-containing filler.

While the mechanism is not completely understood, it has been observed that when certain polymeric fluids having functional groups are applied to the surface of a fuser member having an elastomer surface with metal oxide, metal salt, metal, metal alloy or other suitable metal compound filler dispersed therein, there is an interaction (a chemical reaction, coordination complex, hydrogen bonding or other mechanism) between the metal of the filler in the elastomer and the polymeric fluids having functional groups, so that the polymeric release agent having functional groups in the form of a liquid or fluid provides an excellent surface for release while having an excellent propensity to remain upon the surface of the fuser member. Regardless of the mechanism, there appears to be the formation of a film upon the elastomer surface which differs from the composition of the elastomer and the composition of the polymeric release agent having functional groups. This film, however formed, has a greater affinity for the elastomer having metal oxide, metal salts, metal, metal alloy or other suitable metal compound filler dispersed therein than the toner and thereby provides an excellent release coating upon the elastomer surface. The release coating has a cohesive force which is less than the adhesive forces between heated toner and the substrate to which it is applied and the cohesive forces of the toner. Even though metal oxide, metal salts, metal and metal alloy particles on the surface of the elastomer normally cause release failure, i.e. offset of toner, the use of the polymer release agents having functional groups upon the surface of the elastomer containing metal oxide, metal salt, metal or metal alloy filler has substantially reduced offset problems which are common to fusing devices and processes of the prior art having fuser members with an outer surface of an elastomer or resinous material. The functional group (of the polymeric release agent)-metal (of the metal-containing filler) interaction leads to an overall diminution of the critical or high surface energy of the metal in the metal-containing filler.

Polymeric release agents having functional groups are well known in the prior art. They are described in U.S. Pat. Nos. 4,029,827, 4,078,285, 4,011,362, 1,101,686 and 4,046,795. The polymeric release agents having functional groups as used in this invention may be a solid or a liquid at ambient temperature and a fluid at operating temperatures. By using the term "polymeric" is meant two or more monomer units as a backbone having chemically reactive functional groups attached thereto or attached to side chains and branches of the backbone of the polymer. The reactive functional groups attached to the polymer must be capable of interacting with the metal of the filler dispersed in the elastomer surface of the fuser member. Furthermore, the polymeric release agent having functional groups must form a film or barrier upon the surface of the fuser member, which barrier or film has a surface energy less than the surface energy of the toner at operating temperatures. As used herein metal-containing filler means any metal, metal alloy, metal oxide, metal salt or other metal compound which can be incorporated in the elastomer, and which can interact with the polymeric release agent having functional groups. Since the metal of the metal-containing filler in the outer layer of the elastomer (also designated herein as the release layer elastomer) must interact with the functional groups of the polymeric release agent, it may be designated as a reactive metal-containing filler. Metal-containing fillers include metals, metal alloys, metal oxides and metal salts.

In the process and devices of the present invention, it is critical that the polymeric release agent have functional groups (also designated as chemically reactive functional groups) which interact with the metal-containing filler dispersed in the outer layer of elastomer or resinous material of the fuser member surface to form a thermally stable film which releases thermoplastic resin toner and which prevents the thermoplastic resin toner from contacting the elastomer material itself. It is also critical that the metal oxide, metal salt, metal, metal alloy or other suitable metal compound filler dispersed in at least the outer layer of the elastomer or resin upon the fuser member surface, be a metal oxide, metal salt, metal, metal alloy or other suitable metal compound capable of interacting with the functional groups of the polymeric release agent. Such metal-containing filler materials preferably do not cause gellation of or have any adverse effect upon the polymeric release agent having functional groups.

DESCRIPTION OF THE PREFERRED EMBODIMENTS

Figure 1:
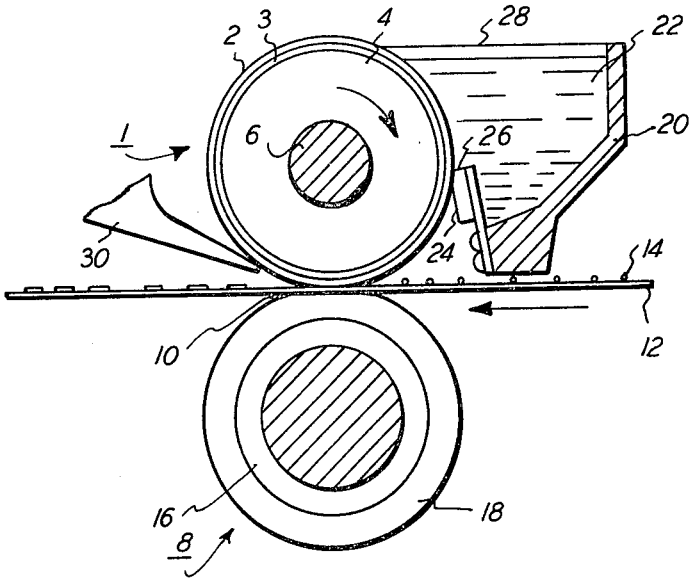
FIG. 1 is a typical side elevational view of a fuser system for a xerographic reproducing apparatus.

The fuser embodiments of the present invention may be used in any xerographic reproducing or duplicating machine using heated roll fusers. Exemplary of an automatic xerographic reproducing machine is the machine described in U.S. Pat. No. 3,937,637. Therein is illustrated a reproducing machine which employs an image recording drum-like member, the outer periphery of which is coated with a suitable photoconductive material. One type of photoconductive material is disclosed in U.S. Pat. No. 2,970,906. The photoconductive drum is suitably journalled for rotation within a machine frame by means of a shaft which rotates to bring the image retaining surface thereon past a plurality of xerographic processing stations. Suitable drive means are provided to power and coordinate the motion of the various cooperating machine components whereby a faithful reproduction of the original input scene information is recorded upon a sheet of final support material such as paper or the like.

Since the practice of xerography is well known in the art, the various processing stations for producing a copy of an original are represented as stations A to E. Initially the drum moves the photoconductive surface through a charging station A. At charging station A an electrostatic charge is placed uniformly over the photoconductive surface of the drum preparatory to imaging. The charging may be provided by a suitable corona generating device. Thereafter, the drum is rotated to exposure station B where the charged photoconductive surface is exposed to a light image of the original input scene information, whereby the charge is selectively dissipated in the light exposed regions to record the original input scene in the form of a latent electrostatic image. A suitable exposure system may be provided by one skilled in the art.

After exposure, the photoconductive drum rotates the electrostatic latent image recorded on the photoconductive surface to development station C, where a conventional developer mix is applied to the photoconductor surface rendering the latent image visible. A suitable development station may include a magnetic brush development system utilizing a magnetizable developer mix having carrier granules and toner comprising electrophotographic resin plus colorant from dyes or pigments. A developer mix is continuously brought through a direction flux field to form a brush thereof. The electrostatic latent image recorded on the photoconductive surface is developed by bringing the brush of developer mix into contact therewith. The developed image on the photoconductive surface is then brought into contact with a sheet of final support material within a transfer station D, and the toner image is transferred from the photoconductive surface to the contacting side of a final support sheet. The final support material may be plain paper, gummed labels, transparencies such as polycarbonate, polysulfone, Mylar, and the like. Mylar is a trademark of E. I. duPont Company.

After the toner image has been transferred to the sheet of final support material, also described herein as a substrate, the sheet or substrate with the image thereon is advanced to a suitable fuser assembly which fuses the transfer powder image thereto. After the fusing process, the final support material is advanced by a series of rolls to a copy paper tray for subsequent removal therefrom by a machine operator. Although most of the toner powder is transferred to the final support material or substrate, some residual toner remains on the photoconductive surface after the transfer of the toner powder image to the substrate. The residual toner particles remaining on the photoconductive surface after the transfer operation are removed from the drum by any one of several well known cleaning means including cleaning corona generating devices used in conjunction with biased resilient knife blades. It is believed that the foregoing description is sufficient for the purposes of the present application to illustrate the general operation of a preferred automatic xerographic copier which can embody the fuser members and methods of the present invention.

In accordance with the present invention, the surface for fixing or fusing a thermoplastic resin powder image to a substrate at elevated temperatures may be either a roll, a flat surface, a belt or any other suitable configuration. However, in accordance with the present invention, the fuser member must comprise a base member having at least two elastomer layers thereon, and the outer or release layer of elastomer must have a metal oxide, metal salt, metal, metal alloy or other suitable metal compound filler dispersed therein. The base layer of elastomer and any other layers of elastomer may optionally contain the metal-containing fillers. The metal-containing filler at least in the outer elastomer layer (release layer elastomer) must be one which can interact with the polymeric release agent having functional groups applied to the fuser member surface to provide a surface abhesive to tackified toner and to release molten thermoplastic resin powder therefrom during the fusing operation, and the metal-containing filler dispersed in the outer layer (release layer) elastomer upon the working surface must be present in an amount sufficient to interact with the polymeric release agent having functional groups. Although the invention is applicable to almost any type of surface which may be used in fixing or fusing a thermoplastic resin powder image to a substrate, for convenience, descriptions set forth herein are directed to fuser roll members which are substantially cylindrical in shape.

The fuser members may be constructed entirely of the elastomer layers, the outermost or release layer having the metal-containing filler dispersed therein, and any intermediate, inner or base layers optionally having the metal-containing fillers dispersed therein, however, in the preferred embodiments, the roll structure comprises a base member made of a hollow cylindrical metal core such as copper, aluminum, steel and the like or metal-coated layers of copper, steel, and aluminum and the like, overcoated with at least two layers of elastomer, at least the outer elastomer layer having metal-containing filler, such as metal oxide, metal salt, metal or metal alloy, dispersed therein. The base member may be any suitable material having a base layer elastomer adhered thereto, and the design is not limited to any particular metal, non-metal or composite.

The elastomers which may be used in the layers of the fuser members in accordance with the present invention must be heat stable elastomer or resin materials which can withstand elevated temperatures generally from about 90° C. up to about 200° C. or higher depending upon the temperature desired for fusing or fixing the thermoplastic resin powder to the substrate. The elastomers used in the various layers, but especially the outer layer elastomer of the present invention must resist degradation or attack by the particular polymeric release agent having functional groups which is used to promote release of the molten or tackified thermoplastic resin powder or toner from the fuser member surface. Exemplary of the elastomers which may be used in the layered fuser members in accordance with the present invention, are the fluoro-silicone elastomers, the silicone carborane elastomers, various other silicone rubbers, fluoroelastomers, vinylidene fluoride-based elastomers, various organic rubbers such as ethylene/propylene diene rubbers, fortified organic rubbers which resist degradation at fusing temperatures, various copolymers, block copolymers, copolymer and elastomer blends, and the like. Any elastomer or resin used in the layers of the fuser members in accordance with the present invention must have thermal oxidative stability, i.e., resist thermal degradation at the operating temperature of the fuser member. Thus the organic rubbers which resist degradation at the operating temperature of the fuser member may be used in any one or all layers of the fuser member. These include chloroprene rubber, nitrile rubber, chlorobutyl rubber, ethylene propylene diene terpolymer rubber (EPDM), butadiene rubber, ethylene/propylene rubber, butyl rubber, butadiene/acrylonitrile rubber, ethylene acrylic rubber, sytrene/butadiene rubber and the like or the foregoing rubbers fortified with additives which thermally stabilize the rubber at least at the operating temperature of the fuser member. Most fuser members are operated at temperatures from about 90° C. to about 200° C. but higher or lower temperatures are also contemplated depending upon the softening or melting point of the toner. Resins having the foregoing properties may also be used in accordance with the present invention. For example, polytetrafluoroethylene (PTFE), fluorinated ethylene-propylene copolymer (FEP) and polyfluoroalkoxypolytetrafluoroethylene (PFA Teflon) may also be used in accordance with the present invention. Any combination of these elastomers may be used in the various layers as long as there are at least two elastomer layers, and the outer layer elastomer used as a working surface contains metal-containing filler.

The preferred elastomers useful in the layers of the fuser members of the present invention are the fluoroelastomers, and the most preferred fluoroelastomers are the vinylidene fluoride-based fluoroelastomers which contain hexafluoropropylene as a comonomer. Two of the most preferred fluoroelastomers are (1) a class of copolymers of vinylidene fluoride and hexafluoropropylene known commercially as Viton A, and (2) a class of terpolymers of vinylidene fluoride, hexafluoropropylene and tetrafluoroethylene known commercially as Viton B. Viton A and Viton B and other Viton designations are trademarks of E. I. duPont de Nemours and Company. Other commercially available materials include Fluorel 2170, Fluorel 2174, Fluorel 2176, Fluorel 2177, Fluorel LVS76, Viton B910, Viton GH, Viton E60C, and Viton E430. Fluorel is a trademark of 3M Company. Mixtures of the foregoing vinylidene fluoride-based fluoroelastomers with tetrafluoroethylene, with silicone rubber, with fluorosilicone rubber and the like may also be compounded. Any suitable heat resistant elastomer or resin may be used as fuser member layers in accordance with the present invention as long as they are resistant to physical and chemical degradation from the particular polymeric release agent having functional groups used as the release agent and as long as the particular metal oxide, metal salt, metal, metal alloy or other metal compound filler or fillers which interact with the polymeric release agent having functional groups can be dispersed in at least the outer layer elastomer in a sufficient amount to produce the chemical interaction between the metal oxide, metal salt, metal, metal alloy or other metal compound and the polymeric release agent having functional groups. As used herein the term elastomer is used interchangeably with resin. Although it is not critical in the practice of the invention the molecular weight range may vary from a low of about 1,000 to a high of about 200,000. The most preferred embodiments, the vinylidene fluoride-based fluoroelastomers have a molecular weight range of about 50,000 to about 100,000, the molecular weight of commercially available Viton E430 being about 75,000.

The most preferred elastomers especially fluoroelastomers having metal, metal alloy, metal salt, metal oxide or other metal compound or fluoroelastomers optionally having metal-containing fillers therein and used in the base layer or any other inner or intermediate layers between the base member and the outer layer elastomer in accordance with the present invention are those elastomers which can be cured by a nucleophilic addition cure of crosslinking agent or agents. Crosslinking with basic nucleophiles (nucleophilic addition) is well known in the art, but the elastomers with or without the metal, metal alloy, metal salt, metal oxide or other metal compound fillers therein and cured with basic nucleophiles result in improved fuser members. Fuser members having these preferred elastomers have about a ten fold reduction in wear rate and demonstrate the improved release of the present invention when the metal, metal alloy, metal salt or metal oxide filled outer layer elastomers are used upon the working surface of the fuser member. At the same time the outer elastomer layer (release layer elastomer) containing metal, metal alloy, metal salt or metal oxide filler or mixtures thereof in conjunction with at least one other layer of elastomer (the base layer elastomer which may optionally contain metal-containing filler dispersed therein) provides a conformable surface which improves copy quality even at high rates of speed such as 7,000 copies per hour.

The basic nucleophile cure system is disclosed and discussed in various journals and articles including a paper entiled "VITON FLUOROELASTOMER CROSSLINKING BY BISPHENOLS" written by W. W. Schmiegel and presented at the South German Meeting of the Deutsche Kautschuk Und Gummi Gesellschaft, Apr. 28–29, 1977. One example of the nucleophilic addition cure system is the bisphenol crosslinking agent with organophosphonium salt accelerator. The phosphonium salt may be exemplified as:

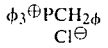

where $\phi$ represents phenyl groups, and the bisphenol is exemplified as:

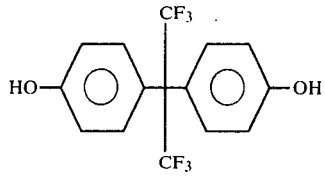

Another example of the nucleophilic addition cure system is crosslinking with a diamine carbamate type curing agent commonly known as DIAK 1. The following scheme showing three separate reactions represents the curing of poly(vinylidene fluoride-hexafluoropropylene) with diamine carbamate as the curing or crosslinking agent:

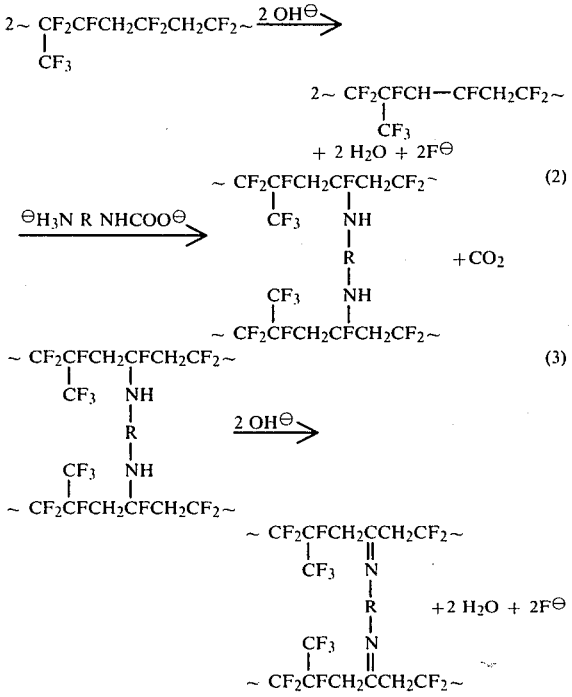

where step 1 shows the loss of HF in the presence of a base; step 2 shows the insertion of the diamine carbamate agent; and step 3 shows post cure in the presence of heat. This mechanism is well known in the art as a crosslinking or curing system. Examples of diamine carbamate cure systems are hexamethylene diamine carbamate known commercially as DIAK No. 1 and N,N'-dicinnamylidene-1,6-hexanediamine known commercially as DIAK No. 3 (DIAK is a trademark of E. I. duPont de Nemours & Co.).

Although other conventional cure or crosslinking systems may be used to cure the elastomers and resins useful in the present invention, for example, free radical initiators such as the peroxide cure system, the nucleophilic addition system is the preferred curing system, especially for fluoroelastomers, in the present invention. By nucleophilic addition curing system is generally meant the use of a bifunctional agent such as a bisphenol or a diamine carbamate to generate a covalently cross-linked network polymer formed by the application of heat following basic dehydrofluorination of the copolymer. Some of the commercially available fluoroelastomer polymers which can be cured by the nucleophilic addition system are Viton E60C, Viton B910, Viton E430, Viton A, Viton B, Fluorel 2170, Fluorel 2174, Fluorel 2176 and the like. Viton is a trademark of E. I. duPont de Nemours & Company, and FLUOREL is a trademark of 3M Company.

The metal oxide, metal salt, metal alloy or other metal compound fillers which may be used in the outer layer elastomer and optionally in the base elastomer or any other inner or intermediate layer in accordance with the present invention, will vary depending upon the particular polymeric release agent having functional groups used as a release agent in the fusing assembly. The metal-containing fillers may be dispersed in the elastomer in any suitable manner, but in the preferred embodiments the metal-containing filler is uniformly dispersed throughout the elastomer layer, coating or body. In certain cases, especially where the fuser member is externally heated and the thickness of the elastomer layers may be a millimeter or greater in thickness, the metal-containing filler may be dispersed or disposed only proximal the working surface of the outer layer elastomer of the fuser member or only in the outermost layer of the fuser member as desired to provide metal at or near the surface for interaction with the polymeric release agent having functional groups. The metal of the metal-containing filler dispersed in the elastomer layers may be easily selected by one skilled in the art without undue experimentation by testing the metal-containing filler, such as a metal, metal alloy, metal oxide, metal salt or other metal compound, in an elastomer. The general classes of metals which are applicable to the present invention include those metals of Groups 1b, 2a, 2b, 3a, 3b, 4a, 4b, 5a, 5b, 6b, 7b, 8 and the rare earth elements of the Periodic Table. The metal-containing fillers include the oxides, the salts and the alloys of the metals in the foregoing groups of the Periodic Table. In certain instances, especially in salts and alloys, certain metals of group 1a of the Periodic Table are also included as metal-containing fillers in accordance with the present invention.

The metal oxide filler dispersed in the outer layer elastomer or in the base layer elastomer or any other inner layers between the outer layer and the base layer may be any metal oxide which can be incorporated in the elastomer without adverse effect upon the elastomer or upon the polymeric release agent having functional groups. Obviously, the release characteristics of the polymeric release agent having functional groups will vary depending upon the particular metal oxide filler dispersed in the outer layer elastomer because of the kinetics of the interaction between the particular metal oxide and the particular functional group or groups, and it will also depend upon the elastomer material itself. This invention will also produce superior release when certain preferred metal oxide fillers are used. For example, the advantages of this invention can be obtained when the metal oxide filler dispersed in the elastomer layers is an oxide of aluminum, copper, tin, zinc, lead, iron, platinum, gold, silver, antimony, bismuth, zinc, iridium, ruthenium, tungsten, manganese, cadmium, mercury, vanadium, chromium, magnesium and nickel and alloys thereof. One skilled in the art can compare the release of various elastomers containing the metal oxides to determine the optimum metal oxide or combinations thereof and concentrations thereof. For example, when the polymeric release agent is one having mercapto functional (thiofunctional) groups, the most preferred metal-containing fillers such as the metal oxides, are those which interact with the sulfur in the mercaptofunctional group to form metal sulfides. In those embodiments where thermal conductivity is of significance, especially in the base layer elastomer or any other inner or intermediate layers of elastomer, the preferred metal oxide fillers are those which have greater thermal conductivity. Thus, more desirable metal oxide fillers dispersed in the elastomer material may comprise copper, silver, gold, lead, and the like.

When the metal fillers are incorporated in the elastomer, any stable metal or metal alloy may be used as long as there is no adverse effect upon the elastomer or the polymeric release agent having functional groups and as long as the metal or metal alloy in the outer layer elastomer interacts with the functional group or groups of the polymeric release agent. In general, the preferred metals are discussed above relative to their location in the Periodic Table of the Elements. Certain metal or metal alloy fillers will produce superior release when incorporated in the outer layer elastomer over other metals or metal alloys, and one skilled in the art can compare the release of various fuser members made in accordance with this invention to determine which metals or metal alloys produce optimum results. Exemplary of the metal or metal alloy fillers useful in the present invention are aluminum, brass, copper, tin, zinc, lead, beryllium, beryllium/copper, steel, iron, platinum, gold, silver, bronze, monel, iridium, ruthenium, tungsten, vanadium, cadmium, chromium, manganese, magnesium, zinc, bismuth, antimony, nickel and alloys of the foregoing metals.

Metal salts may also be incorporated as the metal-containing filler in the elastomers in accordance with the present invention. Any stable salt or salts of the metals discussed above relative to their location in the Periodic Table of Elements capable of interacting with the functional group or functional groups of the polymeric release agent may be used as an outer layer elastomeric filler as long as there is no adverse effect upon the elastomer or the polymeric release agent having functional groups. For example, when the functional group of the polymeric release agent is a mercapto or thio-group, then the metal salt must be able to interact with the sulfur in the mercapto or thio group to form a metal sulfide interaction product. Thus, a metal salt such as lead carbonate, lead iodide or lead fluoride would interact with the sulfur in the mercapto or thio group to form a lead sulfide interaction product. When the functional group of the polymeric release agent is an amino group, then the metal salt must interact with the nitrogen in the amino group to form a metal-nitrogen interaction product. When the functional group of the polymeric release agent is a hydroxyl group, then the metal salt must interact with the oxygen in the hydroxyl group to form a metal-oxygen interaction product. Exemplary of some of the metal salts of the present invention are the acetates, halides (chlorides, fluorides, iodides, and bromides), carbonates, sulfides, sulfates, phosphates, nitrates and the like of lithium, sodium, potassium, calcium, iron, nickel, copper, zinc, aluminum, cadmium, silver, lead, tin, gold, chromium, tungsten and the like. The most preferred metal salts are the salts of heavy metals which form highly insoluble salts, and there is less tendency of such salts to dissolve in the polymeric release agent having functional groups and thereby produce an adverse effect thereon, such as gellation. The least preferred metal salts are those which are soluble in the polymeric release agents having functional groups because such salts would become depleted as a function of time, solubility and use from the surface area of the elastomer (the working surface) and thereby diminish the interaction between the metal and the functional group or groups of the polymeric release agent.

In certain embodiments one or more metals, one or more metal alloys, one or more metal oxides or one or more metal salts may be used in the elastomers of the layers, or mixtures of any of the foregoing such as one or more metals with one or more metal oxides, or one or more metal oxides with one or more metal salts or one or more metal alloys with one or more metals, and the like may be used in the elastomers in accordance with the present invention.

In certain instances, a particular metal, metal alloy, metal oxide metal salt, or other metal compound may have an adverse effect upon the elastomer or the polymeric release agent having functional groups. For example, it has been determined that calcium oxide in the outer layer causes gellation of mercapto functional polyorganosiloxanes and therefore it is detrimental to the release of thermoplastic resin toners. In other cases certain of the metalcontaining fillers may lessen the useful life of an elastomer such as when they are soluble in the polymeric release agent and are leached or otherwise depleted from the working surfaces of the elastomer. When these conditions arise, alternative fillers, elastomers and/or polymeric release agents should be used to produce optimum results.

In accordance with the present invention there are at least two layers of elastomer on the fuser member, one layer being a base layer elastomer and the other layer being an outer layer or release layer elastomer as the working surface of the fuser member. Other intermediate or inner elastomer layers may be used between the outer layer elastomer and the base layer elastomer, and these are defined herein by the phrase "at least one base layer". The same elastomer material having the same metal-containing filler dispersed therein may be used in all layers, or the same elastomer material having different metal-containing fillers dispersed therein may be used in the layers coated upon the fuser member, or different elastomer materials having the same metal-containing fillers dispersed therein may be used in the layers coated upon the fuser member, or different elastomer materials having different metal-containing fillers dispersed therein may be used in the layers of the fuser member. However, as discussed above, the elastomers used in the inner layer or layers and/or the base layer optionally contain a metal-containing filler, that is, depending upon the circumstances, e.g. to promote thermal conductivity, strength, aging stability, to promote cure initiation, and the like, a metal-containing filler may be incorporated in the elastomer of the base layer and any other inner layer or layers, or it may be omitted therefrom. The metal-containing filler must be incorporated in the outer layer or release layer elastomer. The metal-containing filler is also used as desired (optionally) in the base layer and inner layer or layers to promote mechanical (thermal) stability of the elastomers, to promote adhesion to the outer layer, and to promote thermal conductivity. The designation "optionally having metal-containing filler dispersed therein" as used herein defines an elastomer which may have no metal-containing filler therein, trace amounts (less than 1 part by weight based upon the weight of the elastomer) of metal-containing filler therein or substantially large amounts of metal-containing filler therein, e.g. greater than about 1 part by weight and more preferably from about 1.0 to about 95 parts per hundred.

The metal-containing filler may be dispersed in the elastomer material in any suitable or convenient form and manner. The metal containing filler may be in the form of a powder, flakes, spheroids, fibers or any suitable particulate form. It is preferably uniformly dispersed in the elastomer during the compounding of the elastomer, for example, when the elastomer is in the form of a gum, the particulate metal, metal oxide or metal salt or mixture thereof is milled into the gum prior to the curing of the gum to form the elastomer. In general, the metal containing filler is dispersed in the elastomer layer by mixing the selected particulate metal, metal alloy, metal oxide, metal salt or other metal compound or mixtures thereof with the elastomer gum or other millable form of the elastomeric compound preferably prior to solution or homogenization before application to the base member or other surface undergoing coating. The metal-containing filler may be dispersed in the elastomer by conventional methods known to those skilled in the art, as by any suitable means of stirring or blending the particulate metal, metal alloy, metal oxide, metal salt or other metal compound which is generally in the form of a powder or flakes, into the dissolved elastomer, homogenized elastomer or gum. After this dispersion is made, the elastomer gum having the metal-containing filler and the curing agent dispersed therein is then coated upon the base member, for example a cylindrical fuser roll, or any other suitable surface used in making fuser members by any conventional means. Conventional gum compounding agents and solvents may be chosen by one skilled in the art and depends upon the particular elastomer. For example, the vinylidene fluoride copolymers may be dissolved in polar oxygenated solvents such as ketones, acetates and the like. Organic rubbers are soluble in such solvents as toluene. The surface of the elastomer layer having the metal containing filler dispersed therein must be positioned so that it will contact the thermoplastic resin powder image upon the substrate to which it is to be fused or fixed at elevated temperatures. In accordance with the present invention, at the surface of the elastomer layer having a metal containing filler dispersed therein, there will be provided by any means well known in the art, a polymeric release agent having functional groups for the prevention of offsetting or sticking of the thermoplastic resin powder resin or toner to the fuser surface as the thermoplastic resin powder image or toner image contacts the fuser surface at elevated temperatures.

The various layers of elastomer upon the fuser members of the present invention are preferably prepared by applying each layer either in one application or by successively applying to the surface to be coated with the elastomer a thin coating or coatings of the elastomer. Coating is most conveniently carried out by spraying, dipping, and the like, a solution or homogenized suspension of the elastomer containing the filler. Molding, extruding and wrapping are also alternative techniques which may be used to make fuser members in accordance with the present invention. As successive applications of dissolved or homogenized elastomer are made to the surface to be coated, it is generally necessary to heat the film-coated surface to a temperature sufficient to flash off any solvent contained in the film. For example, when a fuser roll is coated with an elastomer layer having metal-containing filler dispersed therein, the elastomer having metal containing filler dispersed therein is successively applied to the roll in thin coatings, and between each application, evaporation of the solvent in the film-coated roll is carried out at temperatures of at least about 25° C. to about 90° C. or higher so as to flash off most of the solvent contained in the film. The temperature of evaporation depends upon the solvent system used. When the desired thickness of coating is obtained, the coating is cured and thereby fused to the layer beneath it. The elastomers may also be applied as a sleeve to a roll or as a mat to flat or other suitable surfaces. Conventional methods known in the art may be used in providing the layers in accordance with this invention, and the method for coating rollers as taught by Aser et al. in U.S. Pat. No. 3,435,500 may be used.

The metal-containing filler must be present in the outer layer elastomer or gum in an amount sufficient to interact with the polymeric release agent having functional groups. This generally comprises an amount greater than about 0.05 volume percent based upon the volume of the elastomer. Preferably, the metal-containing filler or mixtures of metal-containing fillers are present in an amount from about 1.0 to about 15 volume percent based upon the volume of the elastomer. The most preferred range is from about 2.0 volume percent to about 8.0 volume percent. The particle size of the metal-containing filler dispersion in the elastomer of the layers is preferably from about 1 to about 10 microns in size, although particle size is not a limiting factor except the size of the particle cannot be greater than the thickness of the elastomer layer or coating unless the particles have one dimension which is less than the thickness of the elastomer coating, for example when the metal containing filler is in the form of a fiber, flake or flat plate dispersed in the elastomer.

The fuser roll members of the present invention may be constructed entirely of the layer of elastomer, however, in the preferred embodiments, the roll structure comprises a hollow cylindrical core such as copper, aluminum, steel and the like overcoated with at least two layers of elastomer, at least the outer layer of elastomer having metal-containing filler dispersed therein. In these embodiments, the elastomer layers may be of the same thickness or they may be different thicknesses. Each layer of elastomer is generally at least 0.5 mil in thickness and more preferably about 1.5 mils to about 6 mils in thickness. There are many variables which must be taken into consideration in order to provide the most effective thickness of the layers for the fusing operation, and these include such variables as hardness of the fusing surface, thermal conductivity, pressure, roll or contact speed, heat input, heat source and location thereof and the like. The selection and balancing of these variables is well-known in the art and may effect the selection of the particular elastomer, the number of elastomer layers, the thickness of the elastomer layers, the particular metal-containing filler and the particular polymeric release agent having functional groups which are to be utilized in the fusing process and assembly. In certain instances, the composite (i.e. all layers of elastomer may be about 3 to 10 mils used with a conformable pressure or backup roll, or the composite layers may be up to 70 to 100 mils used with a hard pressure or backup roll. If the fuser roll is internally heated, and the thicker elastomer coatings are used therein, then metal-containing fillers or other additives are preferably used in the elastomer to promote thermal conductivity.

Although the metal-containing filler may be directly incorporated or dispersed in the elastomer, in an alternative embodiment, the metal-containing filler may be thoroughly washed and treated before it is dispersed in the elastomer. One of the preferred methods embraces washing or treating the metal-containing filler with the particular polymeric release agent having functional groups to be used in the fuser assembly prior to dispersion of the metal-containing material as a filler in the elastomer. This process may aid in the dispersion of the metal, metal alloy, metal salt, metal oxide or other metal compound filler in the elastomer and may also be used as a means of controlling the interaction between the metal, the elastomer and the release agent having functional groups applied to the surface of the outer layer elastomer. Furthermore, it provides an internal source of the release agent in the outer layer elastomer, and in certain cases eliminates the need for the external application of the polymeric release agent having functional groups.

Other adjuvants and fillers may be incorporated in the elastomers or gums in accordance with the present invention as long as they do not effect the integrity of the elastomers or the interaction between the metal-containing filler and the polymeric release agent having functional groups. Such fillers normally encountered in the compounding of elastomers and gums including coloring agents, reinforcing fillers such as carbon blacks, cross-linking agents, processing aids, accelerators and polymerization initiators, may be used.

The invention is also directed to a method of fusing thermoplastic resin toner images to a substrate comprising: (a) forming a film of polymeric release agent having functional groups upon an outer elastomer surface of a fuser member at elevated temperatures, said fuser member comprising a base member, at least one base layer of elastomer coated upon the base member and an outer layer of an elastomer coated upon the base layer elastomer, said outer elastomer layer having metal-containing filler dispersed therein in an amount sufficient to interact with the film of polymeric release agent having functional groups, and said base layer elastomer optionally containing metal-containing filler dispersed therein; (b) contacting the toner images on said substrate with the coated, heated, elastomer surface for a period of time sufficient to soften the toner; and (c) allowing the toner to cool. The polymeric release agent having functional groups may be applied intermittently or continuously as necessary to maintain release of the molten thermoplastic resin toner and to prevent offsetting. The thickness of the film of polymeric release agent having functional groups is not critical, however, in preferred embodiments, the film is maintained at about 0.1 to about 2 microns in thickness.

In accordance with the present invention, the working surface of the fuser member is the outer layer elastomer having metal-containing filler dispersed therein. As used herein "working surface" of the fuser member is that surface which contacts the toner to cause the toner to fuse to the substrate upon which it is to be affixed permanently. A release material is applied to the "working surface" to prevent offsetting of the toner, especially heated, molten or tackified toner, to the outer layer elastomer surface having metal-containing filler dispersed therein. In accordance with the present invention, these release materials or release agents are polymeric release agent having functional groups which are well known in the art and include the polymer release materials which have reactive functionality and react with the metal-containing filler in the working elastomer surface of the fuser member. Typical of these polymer release materials which have functional groups or reactive functionality are the functionalized polymeric release agents described in U.S. Pat. No. 4,101,686 incorporated herein by reference. In this disclosure, the referenced polymer materials having designated functional groups are applied to a heated fuser member in an electrostatic reproducing apparatus to form thereon a thermally stable layer having excellent toner release properties for electroscopic thermoplastic resin toners. The polyorganosiloxane fluids and other polymeric fluids having functional groups interact with the metal fuser members therein in such a manner as to form an interfacial barrier at the surface of the bare metal fuser member while leaving an unreacted low surface energy release fluid as an outer layer or film. Other release materials are well known in the art and include the polymer release materials which oxidize and react with a metal or metal alloy surface of the fuser member exemplary of which are those described and claimed in U.S. Pat. No. 3,937,637 and U.S. Pat. No. 4,078,285. Other exemplary polymeric release agents having functional groups are those described in U.S. Pat. No. 4,046,795, 4,029,827 and 4,011,362. As used herein, that characteristic of the polymeric release agent or material applied to the outer layer elastomer having metal-containing filler dispersed therein upon the working surface of a fuser member and designated as "reactive functionality" is defined in the foregoing disclosures, and encompasses those polymers which either oxidize and thereby form a functional group which reacts or interacts with the metal filler in the fuser member surface to form the desired toner release layer, or have a built-in functional group or groups which react or interact with the metal of the filler in the fuser member surface to form the desired toner release layer.

A typical fuser member of the present invention is described in conjunction with a fuser assembly as shown in FIG. 1 where the numeral 1 designates a fuser roll comprising elastomer surface 2, also described herein as outer layer or release layer elastomer having metal-containing filler dispersed therein, said elastomer surface 2 being deposited upon elastomer layer 3, also described herein as base layer elastomer, deposited upon or adhering to suitable base member 4 which is a hollow cylinder or core fabricated from any suitable metal such as aluminum, anodized aluminum, steel, nickel, copper, and the like, having a suitable heating element 6 disposed in the hollow portion thereof which is coextensive with the cylinder. Elastomer layer 3 optionally contains metal-containing filler. Backup or pressure roll 8 cooperates with fuser roll 1 to form a nip or contact arc 10 through which a copy paper or other substrate 12 passes such that toner images 14 thereon contact elastomer surface 2 of fuser roll 1. As shown in FIG. 1, the backup roll 8 has a rigid steel core 16 with an elastomer surfce or layer 18 thereon. Sump 20 contains polymeric release agent 22 which has chemically reactive functional groups thereon which are capable of interacting with the metal-containing filler dispersed in elastomer surface 2. The polymeric release agent 22 having functional groups thereon, may be a solid or liquid at room temperature, but it is a fluid at operating temperatures. In preferred embodiments, the chemically reactive groups of polymeric release material 22 in sump 20 are mercapto, carboxy, hydroxy, isocyanate, epoxy, and amino. The most preferred polymeric release agents having functional groups thereon used in accordance with the present invention are the mercapto-functional polyorganosiloxanes.

In the embodiment shown in FIG. 1 for applying the polymeric release agent 22 to outer layer elastomer or elastomer surface 2, a metering blade 24 preferably of conventional non-swelling rubber is mounted to sump 20 by conventional means such that an edge 26 thereof contacts elastomer surface 2 to serve as a metering means for applying the release agent 22 having chemically reactive groups to fuser member 1 in its liquid or fluid state. By using such a metering blade, a layer of polymeric release fluid 22 can be applied to elastomer 2 in controlled thicknesses ranging from submicron thicknesses to thicknesses of several microns of release fluid. Thus, by metering device 24, about 0.1 to 2 microns or greater thicknesses of release fluid can be applied to the surface of elastomer 2. In the embodiment shown, a pair of end seals 28, for example, of sponge rubber, are provided to contain the release material 22 in sump 20. One or more stripper fingers 30 may be provided for insuring removal of the substrate 12 from the surface of elastomer 2.

Figure 2:
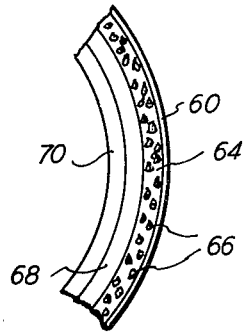
FIG. 2 is a fragmentary view of one embodiment of a fuser member of the present invention.

Referring to FIG. 2, there is shown a fragmentary view of part of the fuser member of the present invention magnified many times over the member shown in FIG. 1 in order to show the thin layers on the fuser member surface. In FIG. 2, the base member or other solid structure upon which the layers of elastomer are applied is designated by numeral 70. Elastomer 68 is deposited upon base member 70 by any suitable means such as curing elastomer 68 directly upon base member 70 or preferably by using an adhesive material to cause the adhesion of elastomer 68 to base member 70 or by fitting a sleeve of elastomer 68 to base member 70 by any suitable means or by any other manner as desired. In the embodiment shown in FIG. 2, there is no metal-containing filler incorporated or dispersed in elastomer 68. Elastomer 68 is also described herein as base layer elastomer or the base layer of elastomer. Elastomer layer 64 is deposited upon elastomer layer 68 by any suitable means, preferably by curing elastomer 64 containing metal-containing filler 66 directly upon elastomer layer 68, or by using various adhesive materials to cause the adhesion of elastomer 64 containing metal filler 66 to elastomer layer 68 or by fitting a sleeve of elastomer 64 containing metal filler 66 to elastomer layer 68 by any suitable means or by any other manner as desired. As used herein, elastomer layer 64 is also designated as outer layer elastomer, outer layer of elastomer or release layer elastomer. As described above, base member 70 is preferably a metal, but it may also be glass or any other suitable material, or as described above the entire fuser member may comprise the elastomer having metal-containing filler therein and the heating element may be external (not shown) rather than internal. The metal-containing filler particles 66 shown in FIG. 2 are illustrated as having irregular shapes, however, any form of metal may be used in elastomer 64 including powders, flakes, platelets, spheroids, fibers, ovoid particles and the like. A film of polymeric release agent having functional groups is shown on the surface of elastomer 64 and is designated by numeral 60. Intermediate layer or layers or inner layer or layers (not shown) may be used between elastomer layer 64 and elastomer layer 68. These are alternatively expressed as "at least one base layer elastomer". The intermediate layer or layers may optionally have the metal-containing filler dispersed therein in accordance with the present invention. These intermediate layers may be deposited upon the base layer elastomer 68 by any of the methods described above. The intermediate or inner layers may be optionally used to promote strength and conformability or compressibility when used in conjunction with a backup or pressure roll. In a preferred embodiment, metal-containing filler 66 is dispersed in elastomer 64 in a concentration from about 1.0 to about 15.0 parts metal-containing filler 66 per 100 parts of elastomer 64. In the embodiment of FIG. 2, only trace amounts of metal-containing filler would be used in elastomer 68, e.g. less than about 0.5 parts of metal-containing filler per 100 parts of elastomer. The same concentrations of metal-containing filler also apply to the intermediate or inner layers.

Figure 3:
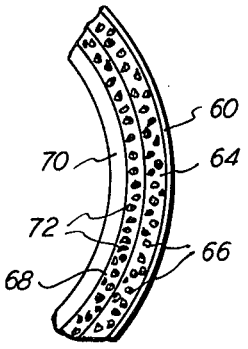
FIG. 3 is a fragmentary view of another embodiment of a fuser member of the present invention.

Referring to FIG. 3, there is shown a fragmentary view of part of the fuser member of the present invention magnified many times over the member shown in FIG. 1 in order to show the thin layers on the fuser member surface. In FIG. 3, the base member or other solid structure upon which the layers of elastomer are applied, is designated by numeral 70. Elastomer 68 is deposited upon base member 70 by any suitable means such as curing elastomer 68 directly upon base member 70 or by any of the alternative methods suggested above for FIG. 2. In the embodiment shown in FIG. 3, metal-containing filler is incorporated or dispersed in elastomer 68. The metal-containing filler incorporated or dispersed in elastomer 68 is identified by numeral 72. Metal-containing filler 72 may be the same metal-containing filler or a different metal-containing filler than the filler identified as numeral 66 in elastomer layer 64. Elastomer 68 in FIG. 3 is also described herein as base layer elastomer or the base layer of elastomer. Elastomer layer 64 is deposited upon elastomer layer 68 by any suitable means, preferably by curing elastomer 64 containing metal-containing filler 66 directly upon elastomer layer 68 or by any other means as described for the elastomer layer of FIG. 2. As in FIG. 2, intermediate layer or layers (not shown) may be used between elastomer layer 64 and elastomer layer 68. The intermediate layer or layers may optionally have the metal-containing filler dispersed therein in accordance with the present invention. As in FIG. 2, the intermediate layers may be deposited upon the base elastomer 68 by any of the methods described above. These intermediate or inner layers may be optionally used to promote strength and conformability or compressability when used in conjunction with a backup or pressure roll.

The thickness of the elastomer layers is not critical in the practice of the present invention. Generally where the fuser member is heated by internal means, the elastomer layers are preferably of such thickness as to constitute a minimal thermal barrier to heat radiating from inside the fuser member to the outermost layer of elastomer having metal filler therein. Recommended thicknesses of each layer are generally greater than 0.5 mil (0.00127 cm), but may be from about 1 mil (0.0025 cm) to about 200 mils (0.5 cm), the most preffered ranges being from about 1 mil (0.0025 cm.) to about 6 mils (0.015 cm.). The preferred thickness depends upon the fuser member configuration and the particular backup or pressure member (hard or conformable) being used with the fuser member. The most preferred two layered fuser member (two elastomer layers) comprise a base layer elastomer thickness of about 6 mils (0.015 cm.) and an outer layer elastomer thickness of about 2 mils (0.005 cm.). In this embodiment the thickness of the base elastomer is 2 or 3 times the thickness of the outer layer elastomer. The most preferred base layer elastomer has about 5.0 to about 20.0 parts metal-containing filler such as magnesium oxide, per 100 parts by weight of elastomer and the outer layer elastomer has about 1.0 to about 95 parts metal-containing filler such as lead oxide, per 100 parts by weight of elastomer.

The release agent may be applied by any suitable means. The sump is illustrated in the drawing, however, the polymeric release agent having functional groups may be applied by spraying from jets or other orifices, by padding from a flat, contoured or other shaped pad made of fabric, sponge, felt or other suitable material, by metering with an applicator roller or series of applicator rollers, or by means of a belt, by means of a solid bar or blade of the release agent material wiping against the fuser members, or by any other suitable applicator means or device. An applicator roll or applicator belt having an elastomer surface with metal-containing filler dispersed therein may also be used to apply the polymeric release agent having functional groups.

The adhesive or primer layer upon the base member to promote the adhesion of elastomer thereto, for example the adhesion of the elastomer to the metal of the base member, is not critical. Anyone skilled in the art can easily select one of many well-known commercial adhesives or primers for adhering particular elastomers or resins to substrates. For example, silicone rubbers are often adhered to substrates with such primers as vinyltrimethoxysilane, gamma-methacryloxypropyltrimethoxysilane and vinyltris (t-butylperoxy) silane and partially hydrolyzed products thereof. Organic rubbers may be adhered to the core material by a primer/rubber adhesive system such as Chemlok 205/236 which may be applied to a metal core. Chemlok 205 is a mixture of polymers, organic compounds and mineral fillers in a methyl isobutyl ketone solvent system. Chemlok 220 and 236 may be used with Chemlok 205 when the bond must have exceptional resistance to adverse environmental conditions. Chemlok 220 is also used as a single coat adhesive for bonding nitrile elastomers. Dissolved organic polymers and dispersed fillers in a xylene and perchloroethylene solvent system may be used for bonding uncured elastomers to metals during vulcanization. One commericial embodiment of this primer is known as Chemlok 220. Chemlok 608 and other well-known dissolved silane polymers are excellent primers for the fluoroelastomers. Chemlok is a trademark of Hughson Chemical Company. Commercial epoxy compounds are also excellent for the bonding of elastomers to metal, plastic and glass substrates. One family of epoxy adhesives or cements is known commercially by the trademark Thixon. Thixon 300 is an epoxy resin well suited for bonding fluoroelastomers such as the Viton elastomers to metal. Thixon is a trademark of Dayton Chemical Products Laboratories.

In the multiple-layer embodiments, the layers of elastomer and/or resin must be compatible, that is, they must be able to become securely bound to each other so that they do not separate from each other for the prolonged period of time they remain in a xerographic apparatus. Generally, it is preferred to have multiple layers of fluoroelastomers, or multiple layers of silicone rubbers, or multiple layers of organic rubbers in a given fuser member, however, one skilled in the art can easily determine which elastomers and resins can be used in multiple layers.

The following examples further define and describe fuser rolls prepared by the present invention and illustrate the preferred embodiments of the present invention.

EXAMPLE I

A solution of silicone elastomer is prepared by mixing the silicone resin with toluene. About 50 grams of micron-sized aluminum oxide particles are washed with toluene and dried. The dried aluminum oxide particles are dispersed in the toluene solution of silicone elastomer, and after the particles are evenly dispersed throughout the solution, the solution is sprayed on the surface of an aluminum cylinder coated with a silane adhesive identified as Chemlok 608. The ratio of aluminum oxide particles to silicone elastomer is about 5 volume percent. Sufficient dissolved silicone elastomer solution is sprayed upon the adhesive-coated cylinder so that the dried layer is 0.015 cm. thick. The elastomer is dried at 90° C. in vacuum to remove the solvent therefrom. A silicone resin in n-hexane solvent containing 1.5 weight percent micron-sized silver powder (based upon the weight of the resin) uniformly dispersed therein is sprayed upon the dried silicone elastomer layer containing aluminum oxide particles. Sufficient silicone resin solution is sprayed thereon to form a dried layer of about 1 mil (0.025 cm.) thick. The n-hexane is evaporated at 60° C. The resulting roll has a configuration similar to that shown in FIG. 3. The roll prepared in the foregoing manner is placed in a fuser assembly as shown in FIG. 1 and is used with a mercapto-functional polyorganosiloxane release agent having a molecular weight of about 14,000 and a mercapto (-SH) concentration of about 0.17 weight percent (based upon the weight of the mercapto-functional polyorganosiloxane). The life of the fuser roll is excellent and excellent release of thermoplastic resin toner is observed with the foregoing fuser roll having silver particles dispersed in the outer layer of silicone resin. No hot offset is observed when this fuser roll heated at 180° C. is used to fix toner images to paper.

EXAMPLE II

A fuser member is prepared in accordance with Example I except both elastomer layers are poly(vinylidene fluoride-hexafluoropropylene) copolymer having a molecular weight of 75,000 and identified as Viton GH. Both layers are cured with a peroxide cure system. Both layers are deposited as dispersions in methyl ethyl ketone. The base layer or first layer of Viton GH is about 0.10 mm thick and the outer layer or second layer of Viton GH is about 0.05 mm thick. The base layer of Viton GH contains about 3 parts by weight based upon the weight of the Viton GH of lead oxide particles having an average particle size of 2 microns to assist the curing of the elastomer. Excellent release is obtained when particles of silver having an average particle size of about 2 microns are present in the outer layer of poly(vinylidene fluoride-hexafluoropropylene) at a concentration of about 1.5 volume percent based upon the volume of the elastomer, and the fuser roll is used in a configuration similar to the fuser assembly shown in FIG. 1 with a release agent of mercapto-functional polyorganosiloxane blended with polydimethylsiloxane, the blend having a molecular weight of about 11,500 and a mercapto content of about 0.17 weight percent.

EXAMPLE III

A fuser roll is made similar to the fuser roll described in Example II except the layers of elastomer are poly(-vinylidene fluoride-hexafluoropropylene-tetrafluoroethylene) terpolymer having a molecular weight of 100,000 and known under the trade name of Viton B using a bisphenol cure system. Excellent release and excellent wear rate are obtained when about 45 parts micron-sized copper particles per 100 parts of Viton B are used in the outer layer, and 3 parts by weight lead oxide are used in the base layer. Excellent release of thermoplastic resin toner and improved wear are observed when the mercapto-functional polyorganosiloxane of Example I is used as the release agent in a fuser assembly similar to that shown in FIG. 1.

EXAMPLE IV

A fuser member was prepared in accordance with Example III except the base layer elastomer was a poly(vinylidene fluoride-hexafluoropropylene) known commercially as Viton E60C and the outer layer elastomer was a poly(vinylidene fluoride-hexafluoropropylene) known commercially as Viton E430 (Viton is a trademark of E. I. duPont de Nemours and Co.). An epoxy adhesive known commercially as Thixon 300 was used on the metal core. Both elastomers were cured with the nucleophilic addition curing agent, bisphenol, known commercially as Viton Curatives 20 and 30. The base layer of Viton E60C was 6.0 mils (0.015 cm.) thick, and the outer layer of Viton E430 was 1.5–2.0 mils (0.0025–0.005 cm.) thick. The outer elastomer layer contained 45 parts by weight lead oxide per 100 parts by weight of the elastomer. The inner layer contained 30 parts by weight carbon black and 15 parts by weight magnesium oxide per 100 parts by weight Viton E60C. In excess of 500,000 copies were fixed in the Xerox 9200 duplicator (Xerox and 9200 are trademarks of Xerox Corporation) using a mercapto-functional polyorganosiloxane release agent having a mercapto content of 0.10 weight percent (based upon the weight of the polyorganosiloxane) metered upon the fuser roll by a wick. Only minimal wear was observed upon the fuser roll surface 0.05 mils per 100 K copies).

EXAMPLE V

A fuser member is prepared in accordance with Example IV using the same elastomers except the elastomers are cured by a bisphenol A curing agent. About 6 parts by weight lead carbonate per 100 parts of elastomer is dispersed in the outer layer elastomer by blending on a rubber mill prior to dissolving in methyl ethyl ketone, spraying upon the fuser cylinder having the same base layer as Example IV, and curing. Suitable release of thermo plastic resin toner is obtained when mercapto-functional polyorganosiloxane is used as the release agent in the Xerox 9200 fuser assembly similar to that of Example IV.

EXAMPLE VI

A fuser roll was prepared by coating an aluminum cylinder having an epoxy adhesive known commercially as Thixon 300 thereon, with a solution of Viton GH containing aa aliphatic peroxide curing agent. Only trace amounts (less than 1 part by weight based upon the weight of the elastomer) of metal-containing filler were incorporated or dispersed in the poly(vinylidene fluoride-hexafluoropropylene) terpolymer known as Viton GH to assist the cure. The elastomer was cured at 232° C. for 24 hours and was placed in a fuser assembly similar to the one shown in FIG. 1. A 250 centistoke polyorganosiloxane fuser oil(polydimethylsiloxane) was used as the release agent. Less than 1,000 copies were fused with this system before release failure.

EXAMPLE VII

A fuser roll identical to the fuser roll of Example VI was prepared with only a trace amount of a metal-containing filler to assist curing. Instead of the linear polydimethylsiloxane (silicone oil) used as the release agent in Example VI, a branched silicone oil (branched polydimethylsiloxane having branching of the siloxane backbone) having a viscosity of about 250 centistokes was used. There was only some improvement over the number of copies fused when conventional silicone oil was used as the release agent.

EXAMPLE VIII

A fuser roll identical to the fuser roll of Example VI having an elastomer coating of Viton A cured with a diamine carbamate curing system (DIAK No.1) and having only trace amounts (less than 0.5 parts by weight lead oxide per 100 parts Viton A) of metal-containing filler to assist the cure was used. A mercapto-functional polyorganosiloxane fluid having a viscosity of about 250 centistokes, a molecular weight of about 11,500 and a mercapto content of about 0.06 percent (based upon the weight of the polyorganosiloxane) was used as the release agent. Although substantially more copies were fused with the fuser member and release agent of this example over the fuser member and release agent of Example VII, the results were still less than desirable.

EXAMPLE IX

Aluminum cylinders similar to Example VI were coated with 6 mils ( 0.015 cm.) of Viton E430 containing 45 parts by weight lead oxide and cured with a bisphenol curing agent. Conventional Viton adhesives were used to coat the aluminum cylinder prior to the application of the Viton E430 elastomer. One cylinder had a silane adhesive or primer known commercially as Chemlok 608 coated thereon, and the other cylinder had an epoxy adhesive or primer known commercially as Thixon 300 coated thereon. The rolls were tested in the fuser assembly of a Xerox 9200 duplicator using a 250 centistoke mercapto-functional polyorganosiloxane release agent having a SH concentration of 0.1. The release agent was metered upon the fuser rolls by a wick. After only about 50,000 copies, the lead oxide-containing layer of Viton E430 separated (de-bonded) from the primed aluminum surface.

EXAMPLE X

A fuser roll having a 1.5 mil layer of Viton E430 with a metal-containing filler was placed upon an aluminum roll identical to the procedure and roll of Example VI. except there was an intermediate 6.0 mil layer of Viton E60C coated upon the epoxy covered aluminum roll. All conditions were identical to the conditions of Example VI except a metal-containing filler, lead oxide, was incorporated into the poly(vinylidene fluoride-hexafluoropropylene) copolymer known as Viton E430 prior to curing with a bisphenol curing system. The lead oxide was about 45 parts per 100 parts by weight of the Viton E430 (7.5 percent by volume). The release agent used in the assembly was identical to the release agent used in Example VIII. Nearly 1,000,000 copies were fused with the fuser member and the mercapto-functional polyorganosiloxane release agent before release failure was observed. The fuser member remained mechanically sound (no de-bonding or separation from the base member).

EXAMPLE XI

A fuser member was prepared in accordance with Example III having a base layer elastomer of poly(vinylidene fluoride-hexafluoropropylene) known commercially as Viton E60C and the outer layer elastomer was a poly(vinylidene fluoride-hexafluoropropylene) known commercially as Viton E430. Both elastomers were cured with the bisphenol curing system known commercially as Viton Curatives 20 and 30. The base layer of Viton E60C was 6 mils thick and the outer layer of Viton E430 was 1.5 mils thick. The base layer of Viton E60C contained 15 parts magnesium oxide and 30 parts carbon black per 100 parts Viton E60C. The outer layer of Viton E430 contained 15 parts lead oxide per 100 parts (by weight) Viton E430. The fuser member having the foregoing elastomer layers was placed in a fuser assembly from a Xerox 9200 duplicator. Over 500,000 copies were fused with the fuser member using the same release agent used in Examples VIII and X without release failure. Very little wear was observed and there was little or no tendency for the elastomer coatings to separate.

A comparison of the results of Example VI through Example XI shows the remarkable improvement of the present invention when a metal-containing filler is incorporated in the elastomer used as the surface coating of a fuser member, said surface coating being deposited upon a base layer of elastomer, when the polymeric release agents having functional groups are used as release agents to fuse thermoplastic resin toner images to substrates such as paper. The number of copies which can be fused with the metal-containing filler in the elastomer are mutiples of hundreds of thousands more than the same fuser member containing no filler or only trace amounts of filler in the elastomer even when the system is used with the same polymeric release agent having functional groups. Wear rates and the tendency of separation of the elastomer layers from the base member (metal cylinder) are substantially improved.

EXAMPLE XII

An aluminum cylinder fuser roll core having a diameter of 2.984 inches (7.58 cm.) taken from a Xerox 9200 copier (Xerox and 9200 are trademarks of Xerox Corporation) was grit blasted, degreased and primed with an epoxy primer known commercially as Thixon 300. A fluoroelastomer copolymer of poly(vinylidene fluoride-hexafluoropropylene) known commercially as Viton E60C having 15 parts magnesium oxide filler per 100 parts by weight of the Viton E60C blended therein along with 3.0 parts of carbon black filler per 100 parts by weight of the Viton E60C, was dissolved in methyl ethyl ketone solvent to make an 18 percent solution. The curing or crosslinking agent for this fluoroelastomer was fluorinated bisphenol A. The solution was repeatedly sprayed upon a primed degreased aluminum base member or core to yield a final thickness of 6.0–8.0 mils (0.015–0.02 cm.). The fluoroelastomer was cured by heating for 1 hour at 165° C. The layer was cooled and sanded. The final thickness of the sanded roll was about 5.0–7.0 mils (0.13–0.18 mm.).

Another fluoroelastomer copolymer of poly(vinylidene fluoride-hexafluoropropylene) known as Viton E430 having 15 parts lead oxide filler per 100 parts by weight of the Viton E430 blended therein was dissolved in methyl ethyl ketone solvent to form a 10 percent solution. The solution was repeatedly sprayed upon the previously-cured layer to form an outer layer or release layer. Sufficient repetitions of the spraying process were made to form a final thickness of the outer layer elastomer of about 2.0–2.5 mils (0.003–0.004 cm.). The fluoroelastomer coating (outer layer) was cured by heating for 16–24 hours at 232° C. The surface of this layer was polished to 1.0–1.5 mils (0.03–0.04 mm.). The roll was placed in a Norman Abrader, and wear data was recorded. Another roll prepared identical to that shown above was placed in a Xerox 9200 duplicator (Xerox and 9200 are trademarks of Xerox Corporation) having a wick release agent applicator, and tested for wear data and release. Over 1,000,000 copies were fused by the roll in the xerographic duplicator using the polymeric release agent of Example VIII. The wear data taken from the xerographic duplicator showed less than 0.05 mils of wear per 100,000 copies, and the Norman Abrader showed 40 microinches of wear per 40 cycles. The two layers of fluoroelastomer depoisted upon the aluminum cylinder displayed no tendency to separate from the cylinder or from each other.

EXAMPLE XIII

Two rolls identical to those described in Example XII were prepared for this experiment except the roll was coated with a base elastomer as in Example XII and overcoated with a fluoroelastomer terpolymer of poly(vinylidene fluoride-hexafluoropropylene-tetrafluoroethylene) having a copolymerized cure site monomer conferring greatly enhanced curability with aliphatic peroxide systems. The fluoroelastomer contained 45 parts by weight lead oxide per 100 parts by weight of the fluoroelastomer. The fluoroelastomer commercially available under the trade designation Viton GH (a trademark of E. I. duPont Company) was cured with a conventional aliphatic peroxide curing agent. These rolls were also tested in a Norman abrader and in a Xerox 9200 duplicator (Xerox and 9200 are trademarks of Xerox Corporation). A wear rate of 0.4 mils of Viton GH per 100,000 copies was observed in the duplicator, however, 500,000 copies were fused in the duplicator using the mercapto-functional polyorganosiloxane fuser release agent of Example X. The wear rate observed in the modified paper abrasion fixture (Normal abrader) for the Viton GH cured with the aliphatic peroxide curing agent was 900 microinches of wear per 40 cycles.

While the invention has been described with respect to preferred embodiments, it will be apparent that certain modifications and changes can be made without departing from the spirit and scope of the invention and therefore it is intended that the foregoing disclosure be limited only by the claims appended hereto.

What is claimed is:

1. A fuser member for fusing electroscopic toner images at elevated temperatures in a fuser assembly of the type wherein a polymeric release agent having functional groups is used as an abhesive layer on the working surface of the fuser member, comprising a base member, at least one base layer of elastomer upon the base member and an outer layer of an elastomer coated upon the base layer of elastomer, said outer layer elastomer having a metal-containing filler dispersed therein in an amount sufficient to interact with the polymeric release agent having functional groups used upon the working surface and said base layer elastomer optionally having metal containing filler dispersed therein.

2. The fuser member of claim 1 wherein the metal-containing filler of the base layer elastomer and the outer layer elastomer is selected from the group consisting of metal, metal alloy, metal oxide and metal salt.

3. The fuser member of claim 2 wherein the metal is selected from the group consisting of copper, tin, silver, zinc, aluminum, iron, lead, molybdenum, platinum, gold, beryllium, nickel, chromium, iridium, ruthenium, tungsten, cadmium and vanadium.

4. The fuser member of claim 2 wherein the metal alloy is selected from the group consisting of alloys of copper, tin, silver, zinc, aluminum, iron, lead, molybdenum, cadmium, platinum, gold, beryllium, chromium, iridium, ruthenium, tungsten, manganese and vanadium.

5. The fuser member of claim 2 wherein the metal oxide is selected from the group consisting of oxides of copper, tin, magnesium, manganese, silver, zinc, aluminum, lead, molybdenum, platinum, gold, beryllium, cadmium, nickel, chromium, iridium, ruthenium, tungsten, vanadium, potassium and sodium and alloys thereof.

6. The fuser member of claim 2 wherein the metal salt is selected from the group consisting of lead carbonate, lead acetate, lead iodide, lead chloride, lead fluoride, lead sulfide, lead sulfate, lead nitrate, zinc acetate zinc chloride, sodium fluoride, sodium acetate, sodium iodide, copper acetate, copper chloride, silver chloride, silver nitrate, silver sulfide, chromium chloride, potassium fluoride and potassium chloride.

7. The fuser member of claim 1 wherein the metal of the metal-containing filler is selected from the group consisting of Groups 1a, 1b, 2a, 2b, 3a, 3b, 4a, 4b, 5a, 5b, 6b, 7b, 8 and the Rare Earth elements of the Periodic Table of the Elements.

8. The fuser member of claim 1 wherein the elastomer of the base layer is cured with a nucleophilic addition curing agent.

9. The fuser member of claim 1 wherein the elastomer of the outer layer is cured with a nucleophilic addition curing agent.

10. The fuser member of claims 8 or 9 wherein the nucleophilic addition curing agent is a bisphenol crosslinking agent.

11. The fuser member of claim 10 wherein the nucleophilic addition curing agent further comprises an organophosphonium salt accelerator.

12. The fuser member of claims 8 or 9 wherein the nucleophilic addition curing agent is a diamine carbamate.

13. The fuser member of claim 1 wherein the base layer elastomer and the outer layer elastomer have a composite thickness of at least about 0.025 mm.

14. The fuser member of claim 1 wherein the base layer elastomer has a thickness of about 0.10 mm to about 0.20 mm and the outer layer elastomer has a thickness of about 0.05 mm to about 0.15 mm.

15. The fuser member of claim 1 wherein the metal-containing filler is present in a concentration in the elastomer greater than about 0.05 volume percent based upon the volume of the elastomer.

16. The fuser member of claim 1 wherein the metal-containing filler is present in the elastomer in a concentration of about 1.0 volume percent to about 15.0 volume percent based upon the volume of the elastomer.

17. The fuser member of claim 1 wherein the base layer elastomer comprises about 1.0 to about 20.0 parts of metal-containing filler per 100 parts of base layer elastomer, and the metal-containing filler of the outer layer elastomer is present in a concentration of about 0.25 to about 95.0 parts of metal-containing filler per 100 parts of outer layer elastomer.

18. The fuser member of claim 1 wherein the base layer elastomer and the outer layer elastomer are fluoroelastomers.

19. The fuser member of claim 18 wherein the fluoroelastomers are selected from the group consisting of poly(vinylidene fluoride-hexafluoro-propylene), poly(-vinylidene fluoride-hexafluoropropylene-tetrafluoroethylene and fluorosilicone rubber.

20. The fuser member of claim 1 wherein the functional groups of the polymeric release agent having functional groups used upon the working surface, are selected from the group consisting of hydroxy, epoxy, carboxy, amino, isocyanate and mercapto.

21. The fuser member of claim 1 wherein the polymeric release agent having functional groups used upon the working surface comprises a mercapto-functional polyorganosiloxane.

22. A fuser member for fusing electroscopic toner images at elevated temperatures in a fuser assembly of the type wherein a mercapto-functional polyorganosiloxane release agent is used as an abhesive layer on the working surface of the fuser member, comprising a base member, at least one base layer of a fluoroelastomer selected from the group consisting of poly(vinylidene fluoride-hexafluoropropylene) and poly(vinylidene fluoride-hexafluoropropylene-tetrafluoroethylene) upon the base member, said base layer fluoroelastomer having 0 to about 15.0 parts metal-containing filler per 100 parts of base layer fluoroelastomer, and an outer layer of a fluoroelastomer coated upon the base layer fluoroelastomer, said outer layer fluoroelastomer having about 0.25 to about 95.0 parts metal-containing filler per 100 parts outer layer elastomer dispersed therein to interact with mercapto-functional polyorganosiloxane release agent used upon the working surface.

23. A method of fusing thermoplastic resin toner images to a substrate comprising:

(a) forming a film of polymeric release agent having functional groups upon an outer elastomer working surface of a fuser member at elevated temperatures, said fuser member comprising a base member, at least one base layer of elastomer adhered to the base member and an outer layer of an elastomer coated upon the base layer elastomer, said outer layer elastomer having metal-containing filler dispersed therein in an amount sufficient to interact with the film of polymeric release agent having functional groups, and said base layer elastomer optionally having metal-containing filler dispersed therein;

(b) contacting the toner images on said substrate with the coated, heated, elastomer surface for a period of time sufficient to soften the toner; and (c) allowing the toner to cool.

24. The method of claim 23 comprising continuously depositing the polymeric release agent having functional groups on the surface of the outer layer elastomer having the metal-containing filler.

25. The method of claim 23 wherein the thickness of the film of polymeric release agent having functional groups is maintained at about 0.1 to about 2 microns.

26. The method of claim 23 wherein the metal-containing filler is selected from the group consisting of metal, metal alloy, metal oxide and metal salt.

27. The method of claim 26 wherein the metal is selected from the group consisting of copper, tin, silver, zinc, aluminum, gold, iron, lead, molybdenum, platinum, beryllium, nickel, chromium, iridium, ruthenium, tungsten, cadmium and vanadium.

28. The method of claim 26 wherein the metal alloy is selected from the group consisting of bronze, brass, monel, beryllium/copper and steel.

29. The method of claim 26 wherein the metal alloy is selected from the group consisting of alloys of copper, tin, silver, zinc, aluminum, iron, lead, molybdenum, cadmium, platinum, gold, beryllium, chromium, iridium, ruthenium, tungsten, manganese, magnesium and vanadium.

30. The method of claim 26 wherein the metal oxide is selected from the group consisting of oxides of copper, tin, magnesium, manganese, silver, zinc, aluminum, iron, lead, molybdenum, platinum, gold, beryllium, cadmium, nickel, chromium, iridium, ruthenium, tungsten, vanadium, potassium and sodium and alloys thereof.

31. The method of claim 26 wherein the metal salt is selected from the group consisting of lead carbonate, lead acetate, lead iodide, lead chloride, lead fluoride, lead sulfide, lead sulfate, lead nitrate, zinc acetate, zinc chloride, sodium fluoride, sodium acetate, copper acetate, copper chloride, silver chloride, silver nitrate, silver sulfide, chromium chloride, potassium chloride, and potassium fluoride.

32. The method of claim 23 wherein the metal of the metal-containing filler is selected from the group consisting of Groups 1a, 1b, 2a, 2b, 3a, 3b, 4a, 4b, 5a, 5b, 6b, 7b, 8 and the Rare Earth Elements of the Periodic Table of the Elements.

33. The method of claim 23 wherein the base layer elastomer is cured with a nucleophilic addition curing agent.

34. The method of claim 23 wherein the outer layer elastomer is cured with a nucleophilic addition curing agent.

35. The method of claims 33 and 34 wherein the nucleophilic addition curing agent is a bisphenol.

36. The method of claims 33 and 34 wherein the nucleophilic addition curing agent is a diamine carbamate.

37. The method of claim 23 wherein the base layer elastomer and the outer layer elastomer have a composite thickness of at least about 0.025 mm.

38. The method of claim 23 wherein the base layer elastomer has a thickness of about 0.10 mm to about 0.20 mm and the outer layer elastomer has a thickness of about 0.05 mm to about 0.15 mm.

39. The method of claim 23 wherein the metal-containing filler is present in a concentration greater than about 0.05 volume percent based upon the volume of the elastomer.

40. The method of claim 23 wherein the metal-containing filler is present in a concentration of about 1 volume percent to about 15 volume percent based upon the volume of the elastomer.

41. The method of claim 23 wherein the base layer elastomer comprises about 1.0 to 15.0 parts metal-containing filler per 100 parts of elastomer, and the metal-containing filler of the outer layer elastomer is present in a concentration of about 0.25 to about 95 parts per 100 parts of outer layer elastomer.

42. The method of claim 23 wherein the base layer elastomer and the outer layer elastomer are fluoroelastomers.

43. The method of claim 42 wherein the fluoroelastomer is selected from the group consisting of poly(vinylidene fluoride-hexafluoropropylene), poly(vinylidene fluoride-hexafluoropropylene-tetrafluoroethylene) and fluorosilicone rubber.

44. The method of claim 23 wherein the polymeric release agent having functional groups which interact with the metal-containing filler in the elastomer comprises a mercapto-functional polyorganosiloxane.

45. In a heated pressure fusing system for fusing toner images in an electrostatic reproducing apparatus in which a fuser roll and a backup roll define a contact arc to fuse toner images onto a substrate and a release agent is applied to the working surface of the fuser roll to prevent toner offset upon the fuser roll, the improvement comprising a fuser roll having a cylindrical base member, at least one base layer of elastomer adhered to the base member, said base layer elastomer optionally having a metal-containing filler dispersed therein, and an outer layer of an elastomer coated upon the base layer elastomer, said outer layer elastomer having a metal-containing filler dispersed therein; the release agent applied upon the working surface of outer layer elastomer being a polymeric release agent having functional groups which interact with the metal in the metal-containing filler.

46. The pressure fusing system in accordance with claim 45 wherein the metal-containing filler dispersed in the elastomer is selected from the group consisting of metal, metal alloy, metal oxide and metal salt.

47. The pressure fusing system of claim 45 wherein the elastomer is cured with a nucleophilic addition curing agent.

48. The pressure fusing system of claim 47 wherein the nucleophilic addition curing agent is a bisphenol.

49. The pressure fusing system of claim 47 wherein the nucleophilic addition curing agent is a diamine carbamate.

50. The pressure fusing system of claim 45 wherein the polymeric release agent having functional groups is a mercapto-functional polyorganosiloxane.

51. The pressure fusing system of claim 45 wherein the elastomers are fluoroelastomers.

52. The pressure fusing system of claim 51 wherein the fluoroelastomers are selected from the group consisting of poly(vinylidene fluoride-hexafluoropropylene), poly(vinylidine fluoride-hexafluoropropylene-tetrafluoroethylene) and fluorosilicone rubber.

53. The pressure fusing system of claim 45 wherein the metal-containing filler is present in a concentration greater than about 0.05 volume percent based upon the volume of the elastomer.

* * * * *